US011420245B2

(12) United States Patent
Gemignani

(10) Patent No.: US 11,420,245 B2
(45) Date of Patent: Aug. 23, 2022

(54) MACHINE FOR THE WORKING OF TUBES PROVIDED WITH A DEVICE FOR DETECTING ANY SLIPPAGE OF THE TUBE BEING WORKED

(71) Applicant: BLM S.p.A., Cantú (IT)

(72) Inventor: Roberto Gemignani, Como (IT)

(73) Assignee: BLM S.P.A., Cantu' (IT)

( * ) Notice: Subject to any disclaimer, the term of this patent is extended or adjusted under 35 U.S.C. 154(b) by 302 days.

(21) Appl. No.: 16/562,233

(22) Filed: Sep. 5, 2019

(65) Prior Publication Data

US 2020/0070227 A1 Mar. 5, 2020

(30) Foreign Application Priority Data

Sep. 5, 2018 (IT) ..... 102018000008354

(51) Int. Cl.

| | |
|---|---|
| ***B21D 11/22*** | (2006.01) |
| ***B21C 51/00*** | (2006.01) |
| ***B21D 9/16*** | (2006.01) |

(52) U.S. Cl.

CPC ..... *B21C 51/00* (2013.01); *B21D 9/16* (2013.01); *B21D 11/22* (2013.01)

(58) Field of Classification Search

CPC . B21D 7/02; B21D 7/16; B21D 11/22; B21D 43/006; B21D 43/025; B21C 51/00

See application file for complete search history.

(56) References Cited

U.S. PATENT DOCUMENTS 4,747,283 A * 5/1988 Moore ..... B21D 7/024 72/154

7,024,905 B1 4/2006 Carlson et al.

FOREIGN PATENT DOCUMENTS

| | | |
|---|---|---|
| BE | 671 311 A | 2/1966 |
| DE | 461 237 C | 6/1928 |
| DE | 19 32 465 U | 2/1966 |
| DE | 12 97 566 B | 6/1969 |
| EP | 0 301 750 A | 2/1989 |
| EP | 0 530 452 A | 3/1993 |
| EP | 0 633 076 A1 | 1/1995 |
| FR | 2 770 794 | 5/1999 |

(Continued)

OTHER PUBLICATIONS

Italian Research Report issued by the Italian Ministry of Economic Development for corresponding Italian Patent Application No. 201800008354. dated Apr. 30, 2019.

(Continued)

*Primary Examiner* — Debra M Sullivan

(74) *Attorney, Agent, or Firm* — Moore & Van Allen PLLC; Henry B. Ward, III

(57) ABSTRACT

The machine comprises a working apparatus arranged to carry out the working operation on a tube, or a similar blank, and a tube feeding device arranged to feed the tube towards the working apparatus. The working apparatus and the tube feeding device comprise respective clamping members for clamping the tube being worked. According to the invention, at least one of the clamping members of the working apparatus or of the tube feeding device is provided with a displacement sensor arranged to detect and measure any movements of the tube relative to said clamping member while the tube is clamped by said clamping member during the working operation.

7 Claims, 4 Drawing Sheets

(56) References Cited

FOREIGN PATENT DOCUMENTS

| | | | |
|---|---|---|---|
| FR | 2 929 140 | A1 | 10/2009 |
| GB | 2 123 325 | A | 2/1984 |
| JP | 62 227 529 | A | 10/1987 |

OTHER PUBLICATIONS

Written Opinion issued by the Italian Ministry of Economic Development for corresponding Italian Patent Application No. 201800008354. dated Sep. 5, 2018.

Preliminary Research Report issued by the French Republic National Institute of Industrial Property for corresponding French Patent No. 2 929 140. dated Aug. 29, 2008.

European Search Report issued by the European Patent Office for corresponding European Patent Application No. EP 94 10 4385. dated Oct. 5, 1994.

* cited by examiner

MACHINE FOR THE WORKING OF TUBES PROVIDED WITH A DEVICE FOR DETECTING ANY SLIPPAGE OF THE TUBE BEING WORKED

BACKGROUND OF THE INVENTION

The present invention generally relates to a machine for the working, for example the bending, of tubes and similar elongated blanks, such as bars and profiled sections.

A machine of the type indicated above is known for example from FR 2 929 140 A1.

In the following description, for convenience, reference will be made to the bending of tubes, it being understood that the invention is applicable to the working, in particular to the bending, of any other elongated blank, irrespective of whether it is a bar, a profiled section, etc.

At present, the most commonly used methods for bending tubes are the so-called draw bending and the so-called compression bending.

As schematically illustrated in FIGS. 1A and 1B of the accompanying drawings, where the tube to be bent is indicated at T, the draw bending method is carried out using a tube bending machine essentially comprising a die 10, which has on its lateral surface a groove 12 with a curved profile of radius R and is rotatably mounted for rotation about an axis of rotation z perpendicular to the longitudinal axis (indicated at x) of the tube T, a pair of clamping blocks 14, which are also rotatably mounted for rotation about the axis of rotation z and one of which is typically formed in a single piece with the die 10, and a pressure block 16, which is carried on a movable slide (not shown) to slide in the direction of the longitudinal axis x of the tube T.

The draw bending method essentially comprises the following two steps:

a) first (FIG. 1A), the tube T is clamped at its front end (where the term "front" refers to the feed direction of the tube T in the machine) between the clamping blocks 14, and b) subsequently (FIG. 1B), the die 10 (and the clamping blocks 14 therewith) is rotated about the axis of rotation z so as to draw the tube T forward winding it at the same time around the groove 12 thereof, while the pressure block 16 accompanies the axial forward movement of the tube T exerting thereon a counter force perpendicular to the longitudinal axis x.

A curve is thus obtained on the tube T with an average radius substantially corresponding to the average radius R of the groove 12 of the die 10.

As schematically illustrated in FIGS. 2A and 2B of the accompanying drawings, wherein parts and elements identical or corresponding to those of FIGS. 1A and 1B have been given the same reference numbers, the compression bending method is carried out using a tube bending machine which essentially comprises, in addition to the die 10 (which in this case is fixed in rotation, instead of rotatably mounted) with its groove 12, a pair of clamping blocks 14 and a bending block 16' which is rotatable about the axis of rotation z.

The compression bending method essentially comprises the following two steps:

(a) first (FIG. 2A), the tube T is clamped at its rear end between the clamping blocks 14 so as to protrude forward beyond the die 10 and the bending block 16', and b) subsequently (FIG. 2B), with the tube T clamped not only between the clamping blocks 14, but also between the die 10 and the bending block 16', the bending block 16' is rotated about the axis of rotation z, thereby winding the tube T on the die 10 and generating on the tube a curve having an average radius substantially corresponding to the average radius R of the groove 12 of the die 10.

Regardless of the type of method used, one of the major risk factors in tube bending is the displacement (slippage) of the tube with respect to the clamping blocks. The slippage of the tube relative to the clamping blocks often causes, in fact, wrinkles in the material of the tube. These wrinkles, in addition to adversely affecting the surface finish of the tube, may lead to breakage of parts of the bending apparatus (for example the core inserted inside the tube). The greater the amount of slippage, i.e. the greater the displacement of the tube with respect to the clamping blocks, the greater the damage that the tube slippage may cause.

More generally, in any tube working machine wherein the tube to be worked must be clamped by means of special clamping members, irrespective of whether they are part of the working apparatus or of the tube feeding device by which the tube is fed to the working apparatus, any slippage of the tube with respect to the clamping member(s) may adversely affect the quality of the working operation and even cause damage to the machine.

SUMMARY OF THE INVENTION

It is therefore an object of the present invention to provide a machine for the working (e.g. bending) of tubes or other elongated blanks that is not affected by the above discussed drawbacks of the prior art.

This and other objects are fully achieved according to the invention by virtue of a machine as claimed herein.

In summary, the invention is based on the idea of mounting, on at least one of the clamping members of the machine, be it a clamping member of the working apparatus or a clamping member of the tube feeding device, which during the working operation is arranged to clamp a section of the tube being worked, a contactless displacement sensor for detecting and measuring any slippage of the tube (in terms of displacement along the longitudinal axis of the tube and/or rotation around the longitudinal axis of the tube) relative to the clamping member on which the sensor is mounted.

Thanks to the use of such a displacement sensor, it is therefore possible to detect in real time, during the working operation, any slippage of the tube being worked with respect to the clamping member on which the displacement sensor is mounted and, on the basis of this detection, allow the control unit of the machine to determine whether to interrupt the working operation (for example if the tube has been found to slip with respect to the clamping member to such an extent that the integrity of the machine is at risk) or to vary the forces exerted on the tube (for example by increasing the clamping force exerted by the clamping member on the tube) to avoid any further slippage of the tube.

Preferably, the displacement sensor is an optical sensor comprising:

- a light source (LED or laser) for illuminating a portion of the surface of the tube being worked,
- a camera for acquiring instant by instant images of said surface portion of the tube, and
- a processing unit for determining at each instant, on the basis of the image of said surface portion of the tube acquired by the camera at that instant and the image acquired at the previous instant, any displacement of said surface portion of the tube with respect to the clamping member between the previous instant and the current instant.

Such a displacement sensor is reliable, accurate, fast, inexpensive and moreover easy to integrate into existing machines. In the case of tube bending machines, the displacement sensor may be installed regardless of whether these machines are configured to carry out the bending process according to the draw bending method or the compression bending method. Depending on the bending method carried out by the machine, it shall be in fact sufficient to mount the displacement sensor in the appropriate position.

Moreover, as already mentioned, depending on the specific application the displacement sensor may be mounted not only (or not so much) on a clamping member of the working apparatus, but also (or rather) on a clamping member of the tube feeding device.

BRIEF DESCRIPTION OF THE DRAWINGS

Further features and advantages of the present invention will become more apparent from the following detailed description, given purely by way of non-limiting example with reference to the accompanying drawings, wherein.

DETAILED DESCRIPTION OF THE INVENTION

Figure 1A:
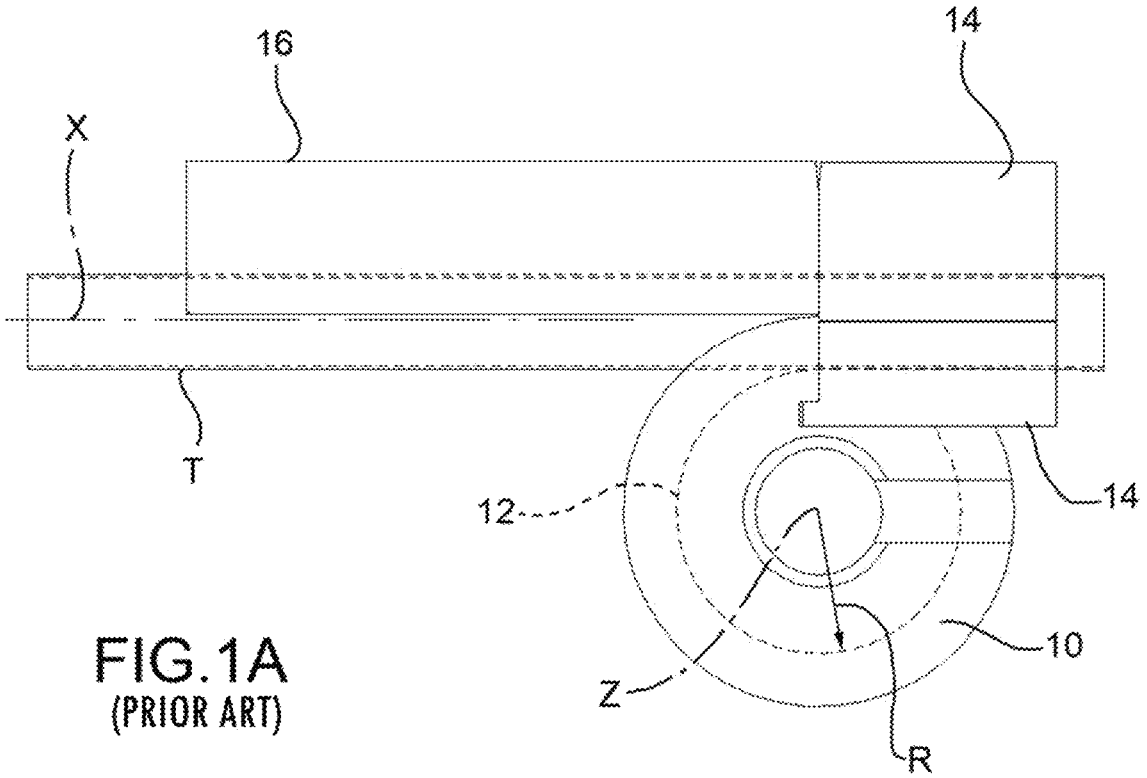
FIG.1A (PRIOR ART)
FIGS. 1A and 1B schematically show a tube bending apparatus arranged to operate according to the draw bending method, at the beginning and at the end of the bending operation, respectively.
Figure 1B:
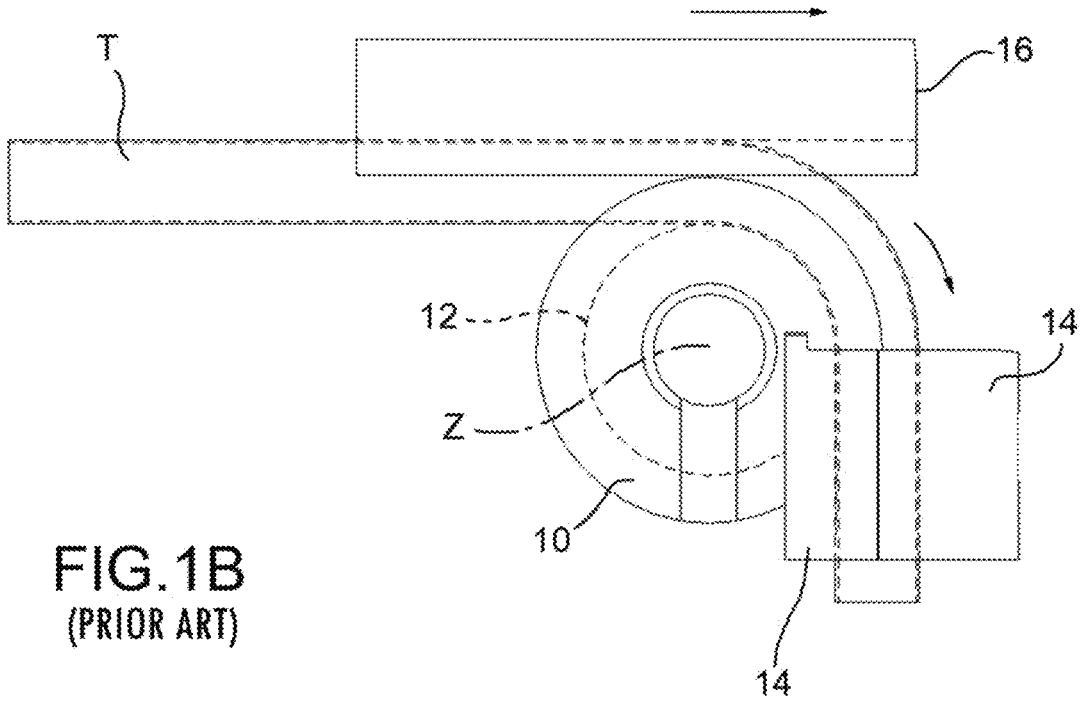
FIG.1B (PRIOR ART)
Figure 2A:
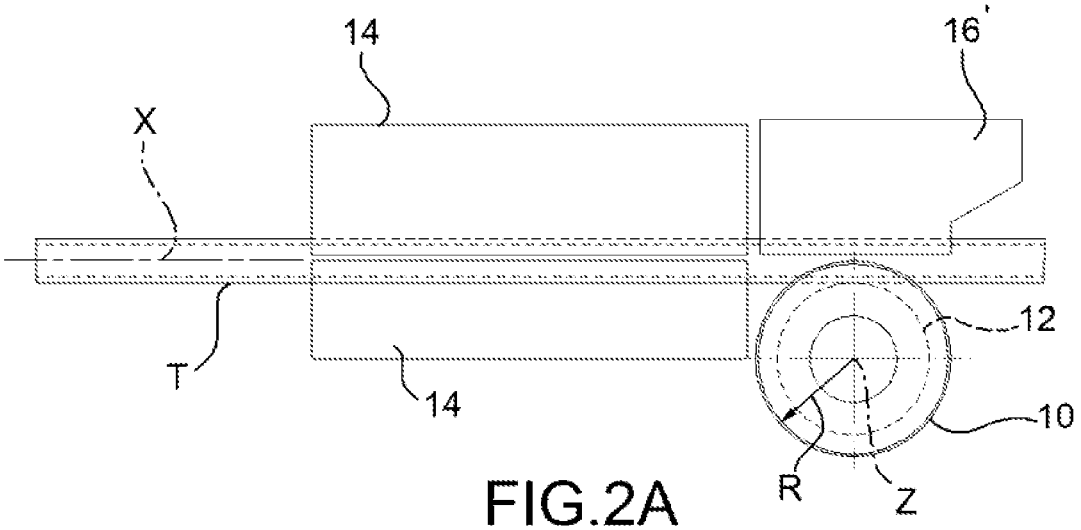
FIG.2A (PRIOR ART)
FIGS. 2A and 2B schematically show a tube bending apparatus arranged to operate according to the compression bending method, at the beginning and at the end of the bending operation, respectively.
Figure 2B:
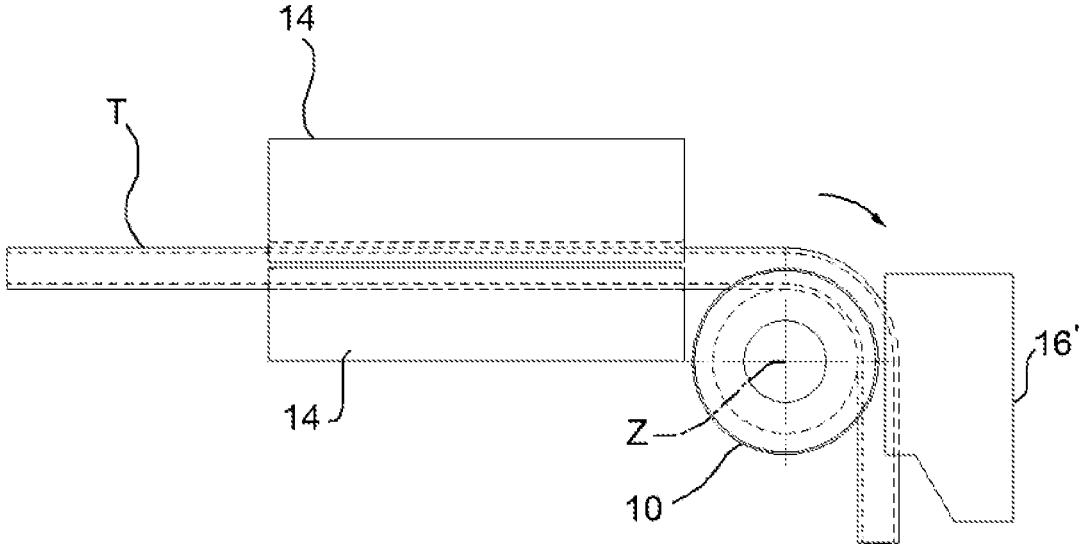
FIG.2B (PRIOR ART)
Figure 3:
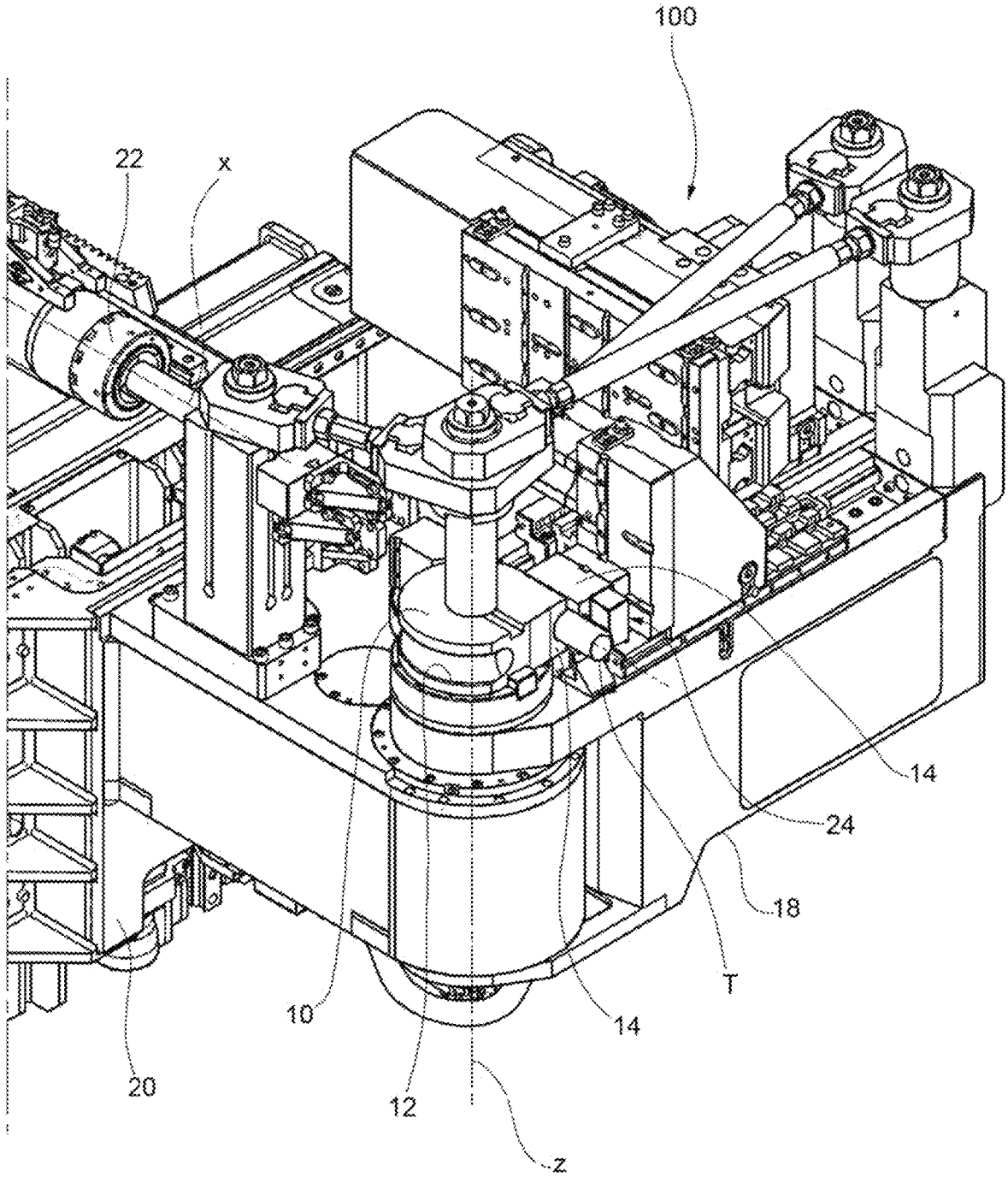
FIG. 3 is a perspective view of a tube bending machine according to an embodiment of the present invention.

With reference to FIG. 3, wherein parts and elements identical or corresponding to those of FIGS. 1A and 1B are indicated with the same reference numbers, a tube working machine according to an embodiment of the present invention is generally indicated at 100.

The machine 100 shown in FIG. 3 is arranged to bend tubes, in particular according to the draw bending method (i.e. according to the bending method described above with reference to FIGS. 1A and 1B). As will be clear from the following description, the present invention is not however limited to a tube bending machine. Moreover, in the case of application to a tube bending machine, the present invention is not limited to a tube bending machine operating according to the draw bending method but is applicable to tube bending machines operating according to other bending methods, for example according to the compression bending method.

The structure and operation of the machine 100 are known per se (and have been, at least in part, already illustrated in the introductory part of the present description with reference to FIGS. 1A and 1B) and will therefore not be described in detail here.

The machine 100 basically comprises a working apparatus, which in the embodiment proposed herein is a bending apparatus arranged to carry out the bending of the tube T according to the draw method and therefore comprises a die 10 having a shaped groove 12, a pair of front clamping blocks 14 for clamping the tube T to be bent, and a rear pressure block 16. More specifically, in the illustrated embodiment one of the two clamping blocks is made in a single piece with the die 10. The die 10 and clamping blocks 14 are carried by an arm 18, which is rotatably mounted on a machine base 20 (only partially visible in FIG. 3) for rotation about an axis of rotation z, which in the illustrated example is oriented vertically. The machine 100 further comprises a tube feeding device 22 for gripping the tube T to be bent by means of suitable clamping members (known per se and thus not illustrated in detail) and feeding it in the direction of its longitudinal axis (indicated at x) towards the working apparatus, as well as (optionally) rotating it about its longitudinal axis x.

Figure 4A:
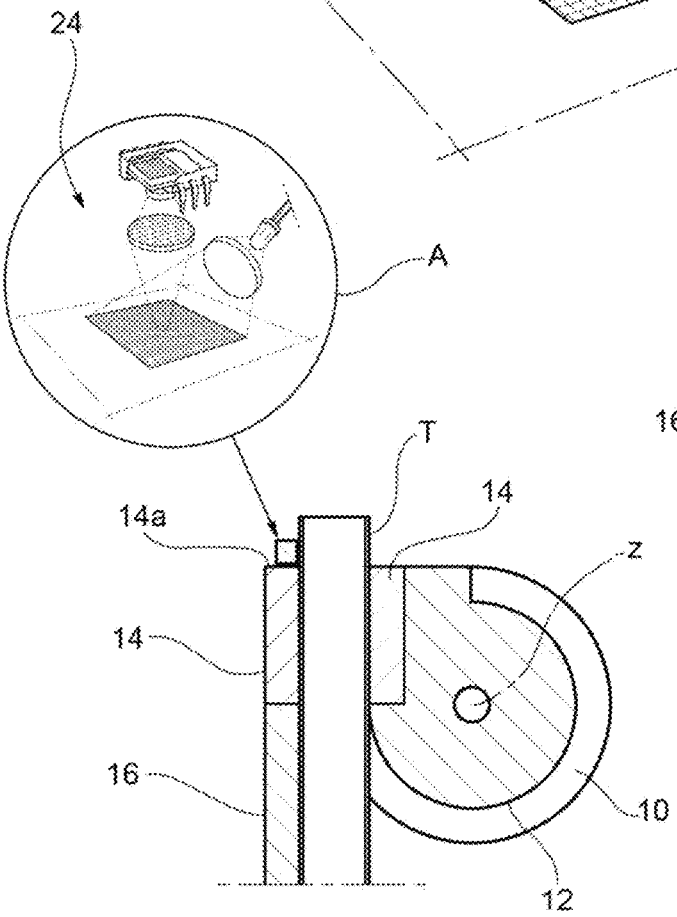
FIGS. 4A and 4B schematically show the bending apparatus of the tube bending machine of FIG. 3, at the beginning and at the end of the bending operation, respectively.
Figure 4B:
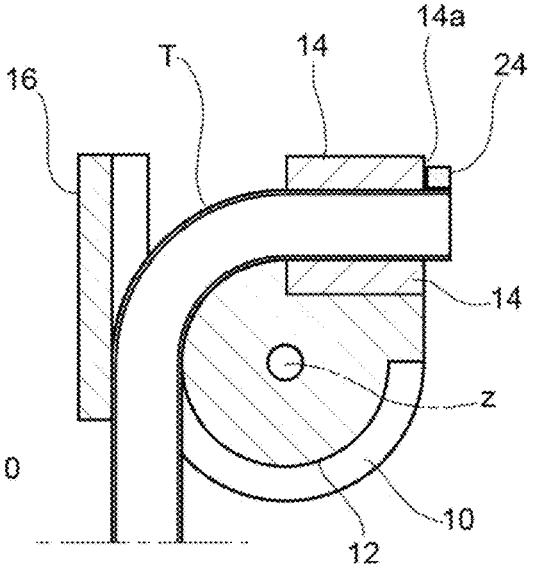

FIGS. 4A and 4B schematically show the bending apparatus of the machine 100 at the beginning and at the end of the bending operation, respectively. As already explained in the introductory part of the description, the bending operation is carried out first by clamping the tube T between the two clamping blocks 14 and then, with the tube T held between the two clamping blocks 14, by rotating the arm 18 (and, therefore, both the die 10 and the clamping blocks 14 therewith) about the axis of rotation z, while the pressure block 16 is moved forward in the direction of the longitudinal axis x to accompany the forward movement of the tube T and counteract, by applying a counter force perpendicular to the longitudinal axis x, the deformation of the free portion of the tube T that is not to be subjected to bending.

The machine 100 also comprises, as is well known, a control unit that is suitably programmed to manage the movements of the components of the bending apparatus (die 10, clamping blocks 14 and pressure block 16), as well as the tube feeding device 22, according to the number, the bending radius and the orientation of the curves to be made on the tube T, as well as according to the distance between each curve and the subsequent one.

As explained above, for the correct operation of a machine of this type, it is advantageous to avoid, or in any case limit, during the bending operation any slippage of the tube T with respect to the clamping members of the machine, for example with respect to the clamping blocks 14 between which the tube T is held clamped, near the tube section to be bent.

In order to provide the control unit of the machine, in real time during the bending operation, with information regarding any slippage of the tube T with respect to the clamping blocks 14, the bending apparatus is equipped with a displacement sensor 24, in particular a contactless displacement sensor, which is mounted on one of the clamping blocks 14 and is arranged to detect and measure any relative movements of the tube T with respect to the clamping blocks 14.

As an alternative, or in addition, to a displacement sensor for detecting and measuring any relative movements of the tube T with respect to the clamping blocks 14 of the bending apparatus, it is possible to provide (according to a further embodiment of the invention, not shown in the drawings) a displacement sensor for detecting and measuring any relative movements of the tube T with respect to the clamping members of the tube feeding device 22.

As shown in FIG. 3, as well as in FIGS. 4A and 4B, in the illustrated embodiment, which as mentioned above refers to the case of a tube bending machine arranged to bend tubes according to the draw bending method, the displacement sensor 24 is advantageously mounted on a front face 14*a* of one of the two clamping blocks 14. Depending on the bending method used by the machine, however, other arrangements of the displacement sensor 24 may be envisaged. In general, the displacement sensor 24 will be mounted on an element of the bending apparatus that is arranged to clamp the tube T during the bending operation and will be placed near the lateral surface of the tube T.

Preferably, the displacement sensor 24 is an optical sensor for measuring any relative movement of the tube T with respect to the clamping member on which the sensor is mounted on the basis of an appropriate processing of images of a surface portion of the tube acquired in subsequent instants by the sensor, as will be explained in detail below.

Figure 5:
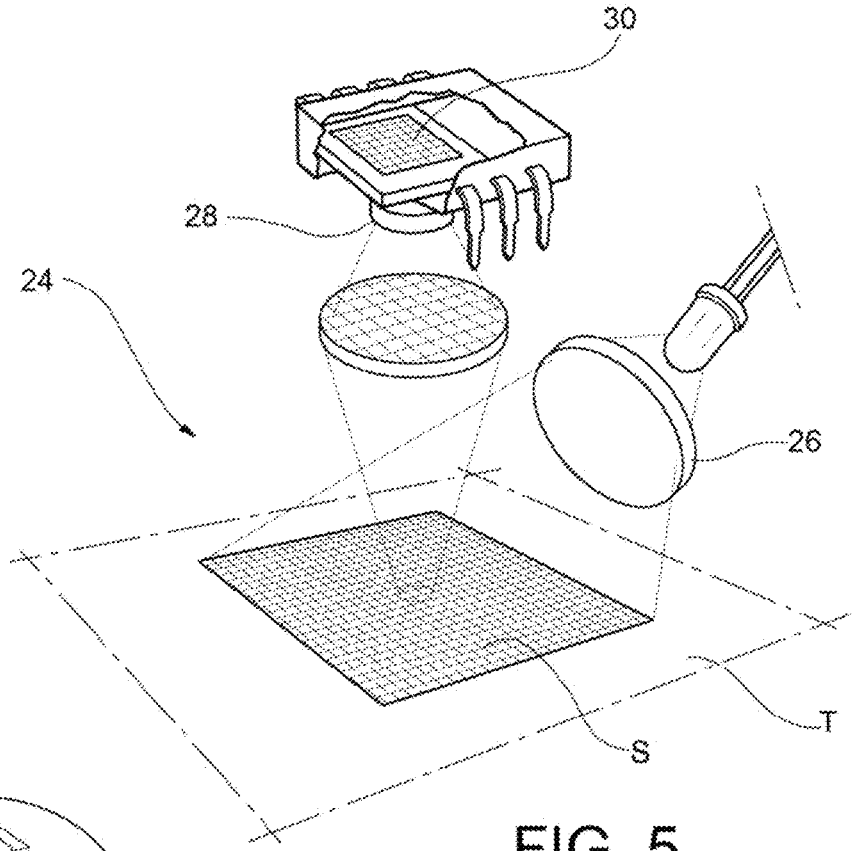
FIG. 5 shows, on an enlarged scale, the detail A of FIG. 4A.

With reference to FIG. 5, in case of a displacement sensor 24 made as an optical sensor, it essentially comprises a light source 26 (for example a laser or LED source) for illuminating a surface portion S of the tube T, a camera 28 for high-frequency acquisition of images of the surface portion S, and a processing unit 30 arranged to determine at any given instant, on the basis of the comparison between the image of the surface portion S acquired in that instant by the camera 28 and the image acquired at the previous instant, a possible movement of the tube T with respect to the clamping member on which the sensor 24 is mounted (in this case with respect to the clamping block 14), determining in particular both the extent and the direction of this movement.

The images acquired by the camera 28 are very small, for example fifteen pixels per side, but contain tiny details and imperfections of the surface portion S of the tube T in front of which the displacement sensor 24 is placed. The images acquired by the camera 28 are processed in pairs by the processing unit 30 and each pair of consecutive images is used to calculate the displacement (if any) of the tube T with respect to the clamping block 14 in the time interval between the two instants at which these images have been acquired.

For example, the displacement between two consecutive images is determined by cross-correlation. Indicating with $I_A(i,j)$ the grey intensity (the images are, in fact, acquired in grey scale) of each pixel of coordinates i, j of the first image, with $I_B(i,j)$ the grey intensity of the same pixel of the second image, and with m and n the displacement (in pixels) of the second image with respect to the first one in the two perpendicular directions, the correlation function $\Phi(m,n)$ is equal to the total sum of the products of the grey intensities of each pixel of the two images, according to the following equation:

$$\Phi(m, n) = \sum_{i,j} I_A(i, j) I_B(i+m, j+n)$$

The correlation function $\Phi$ takes its maximum value when the two images are perfectly superimposed. In order to determine the displacement between two consecutive images, displacement values m and n in the two directions that maximize the function are calculated. On the basis of these displacement values between consecutive pairs of images, the amount and direction of displacement of the surface portion S of the tube T facing the displacement sensor 24 with respect to the clamping block 14 are determined instant by instant.

If, during the bending operation, the displacement sensor 24 detects a displacement of the tube T with respect to the clamping block 14, the control unit of the machine may, depending for example on the amount of this displacement, immediately interrupt the working process or vary the forces exerted on the tube T (for example, by increasing the clamping force exerted by the clamping block 14 on the tube T to avoid further slippage of the tube relative to the clamping block).

As is clear from the preceding description, providing a tube working machine, such as for example a tube bending machine, with a displacement sensor, such as, in particular, an optical sensor, that is able to detect any movements (slippage) of the tube with respect to a clamping member of the machine (irrespective of whether it is a clamping member of the working apparatus and/or a clamping member of the tube feeding device) during the working process, ensures a more reliable operation of the machine, as it allows, for example, to avoid damage or breakage of components of the working apparatus resulting from the formation of wrinkles on the tube caused by the slippage of the tube. Such a displacement sensor, especially if it is made as an optical sensor, is inexpensive, easy to install (even on existing machines), very accurate and reliable.

Naturally, the principle of the invention remaining unchanged, the embodiments and the constructional details may vary widely from those described and illustrated purely by way of non-limiting example, without thereby departing from the scope of the invention as defined in the appended claims.

What is claimed is:

1. A machine for the working of elongated blanks, comprising a working apparatus arranged to carry out one or more working operations on an elongated blank, and a blank feeding device arranged to feed the elongated blank towards the working apparatus, wherein the working apparatus and the blank feeding device comprise respective clamping members for clamping the elongated blank during the working operation, wherein at least one of the clamping members of the working apparatus and of the blank feeding device is provided with a displacement sensor arranged to detect and measure in a contactless manner any movements of the elongated blank relative to said clamping member while the elongated blank is clamped by said clamping member during the working operation.

2. The machine of claim 1, wherein the displacement sensor is an optical sensor arranged to detect and measure any movements of the elongated blank relative to said clamping member on the basis of the digital processing of images of a surface portion of the elongated blank acquired by the displacement sensor in successive time instants.

3. The machine of claim 2, wherein the displacement sensor comprises a light source for illuminating said surface portion of the elongated blank, a camera for acquiring images of said surface portion of the elongated blank, and a digital processing unit for determining at each time instant, based on the comparison between the image of said surface portion of the elongated blank acquired by the camera in that time instant with the image acquired at the preceding time instant, any movements of the elongated blank relative to said clamping member.

4. The machine of claim 1, further comprising a programmable controller for managing the working operation on the elongated blank by controlling the movements of the elongated blank feeding device, as well as of movable parts of the working apparatus, wherein the controller is connected to the displacement sensor for receiving therefrom data relating to any movements of the elongated blank relative to said clamping member during the working operation.

5. The machine of claim 4, wherein the controller is programmed to vary the forces acting on the elongated blank during the working operation and/or to interrupt the working operation in case the displacement sensor detects a movement of the elongated blank relative to said clamping member exceeding a given threshold.

6. The machine of claim 1, wherein the machine is arranged to carry out bending operations on the elongated blank.

7. The machine of claim 6, wherein the working apparatus comprises a die suitably shaped, around which during the bending operation a section of elongated blank to be bent is deformed, and a pair of said clamping members arranged to clamp the elongated blank near said section of elongated blank to be bent, and wherein the displacement sensor is mounted on either of the clamping members.

* * * * *